US006281629B1

(12) United States Patent
Tanaka et al.

(10) Patent No.: US 6,281,629 B1
(45) Date of Patent: Aug. 28, 2001

(54) SHORT ARC LAMP HAVING HEAT TRANSFERRING PLATE AND SPECIFIC CONNECTOR STRUCTURE BETWEEN CATHODE AND ELECTRODE SUPPORT

(75) Inventors: Hideo Tanaka; Masanori Takahashi, both of Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/199,572

(22) Filed: Nov. 25, 1998

(30) Foreign Application Priority Data

Nov. 26, 1997 (JP) ..... 9-339506
Nov. 26, 1997 (JP) ..... 9-339507

(51) Int. Cl.[7] ..... H01J 17/04; H01J 61/04; H01J 1/02; H01J 7/24; H01J 61/52

(52) U.S. Cl. ..... 313/631; 313/46; 313/39; 313/110; 313/113; 313/632; 313/634; 313/635

(58) Field of Search ..... 313/11, 17, 18, 313/19, 21, 25–27, 28, 39, 46–47, 355, 491–93, 631–32, 634–635, 637–38, 643, 570, 573–74, 110, 111, 113, 623

(56) References Cited

U.S. PATENT DOCUMENTS

| | | | | |
|---|---|---|---|---|
| 3,731,133 | | 5/1973 | McRae et al. . | |
| 5,399,931 | * | 3/1995 | Roberts | 313/46 |
| 5,561,338 | * | 10/1996 | Roberts et al. | 313/46 |
| 5,672,931 | * | 9/1997 | Kiss et al. | 313/44 |
| 5,789,863 | | 8/1998 | Takahashi et al. . | |

* cited by examiner

*Primary Examiner*—Nimeshkumar D. Patel
*Assistant Examiner*—Mack Haynes
(74) *Attorney, Agent, or Firm*—Nixon Peabody LLP; David S. Safran

(57) ABSTRACT

A short arc lamp with a reflection surface integrated in one piece, and in which, even when the lamp is being operated over a long time, neither a reduction of the reflection factor nor breakage of the lamp main part occurs is achieved. In particular, in such a lamp having a lamp main part made of an insulator in which a reflection surface is provided bounding a concave discharge space, a cathode and an anode located opposite one another in the discharge space with a discharge gap therebetween in a focal position of the reflection surface, an annular, first feed component attached on an open end of the reflection surface of the lamp main part and to which a conductive electrode support component is connected which supports the cathode, and a block-shaped, second feed component which supports the anode and which is located at a base surface of the lamp main part at an end opposite the open end, a plate-shaped, heat transferring component is located between the base surface of the lamp main part and the second feed component which has a thermal conductivity which is higher than that of the second feed component, and/or the conductive electrode support component is straight, with one end of the conductive electrode support component attached in the first feed component and an opposite end of the conductive electrode support component loosely installed in a gap formed in the first feed component where it is held in a manner enabling it to move in a radial direction of the first feed component during thermal expansion, and with the cathode attached in the center of the conductive electrode support component.

3 Claims, 3 Drawing Sheets

SHORT ARC LAMP HAVING HEAT TRANSFERRING PLATE AND SPECIFIC CONNECTOR STRUCTURE BETWEEN CATHODE AND ELECTRODE SUPPORT

BACKGROUND OF THE INVENTION

1. Field of the Invention

The invention relates to a short arc lamp. The invention relates especially to a short arc lamp with a reflection surface integrated in one piece, in which a reflection surface is formed in the lamp main part which forms the discharge space.

2. Description of Related Art

Short arc lamps are known which are produced as follows:

A lamp main part, which forms the discharge space in which there is a pair of electrodes, is made of a ceramic which is an opaque insulator material.

In this lamp main part, a concave reflection surface is formed with a cross-sectional shape which is oval or parabolic.

The opening of the reflection surface of the lamp main part which is used as the light exit part is covered with translucent material.

This short arc lamp with a reflection surface integrated in one piece has the advantage that the light source device is small, since the lamp need not be combined with a reflector. Furthermore, the lamp is extremely robust because it has an essentially cylindrical outside shape. Handling is therefore simple, and is used for those devices in which parallel beams from a strong point light source are desired, such as for a projection apparatus, a spectrometer or the like, in which a point light source is focused on a microscopically small surface and illumination and heating are produced via optical fibers or the like, as well as in similar contexts. A short arc lamp of this type is disclosed, for example, in Japanese patent SHO 54-37436 (U.S. Pat. No. 3,731,133).

FIG. 5 schematically shows a conventional short arc lamp with a reflection surface integrated in one piece. In the representation, in a concave discharge space D is formed in a lamp main part 1 consisting of an isolating component, there are a cathode 21 and an anode 22 opposite one another. On the inside of the discharge space D, a reflection surface 1*a* is formed. On the base surface 1*b* of the lamp main part 1 a block-like, second feed component 3 is installed in which the anode 22 is secured by brazing. The anode 22 extends from the middle opening 11 on the base side of lamp main part 1 into the discharge space 11. On the other hand, the cathode 21 is supported by a conductive, electrode supporting component 5 which is connected to an annular first feed component 4 which, in turn, is attached over the open end of the lamp main part 1. By turning on the first feed component 4 and the second feed component 3, a discharge takes place between the cathode 21 and the anode 22, by which the lamp is operated.

Since the cathode 21 and the anode 22 are located at the focal position of the reflection surface 1*a,* with a cross sectional shape which is oval or parabolic, the anode 22 is located in the vicinity of the central opening 11 on the base side of the lamp main part 1. When the lamp is being operated, especially the anode 22 reaches an extremely high temperature. In the lamp main part 1, therefore, the vicinity of the central opening 11 is greatly heated. Since the lamp main part 1 is formed from ceramic, it has low thermal conductivity. The heat in the vicinity of the central opening 11 is therefore poorly distributed within the lamp main part 1. This heat is, therefore, conducted and emitted to the second feed component 3 which is installed on the base surface 1*b* of the lamp main part 1.

When the anode 22, which reaches an extremely high temperature during operation, is brazed into the second feed component 3, a brazing filler metal of copper with a high melting point is needed. Therefore, the second feed component 3 is formed from an iron-based metal with a thermal stability temperature higher than the melting point of the copper brazing filler metal. However, an iron-based metal does not have very high thermal conductivity.

The heat conducted from the vicinity of the central opening 11 of the lamp main part 1 to the central area of the second feed component 3 is, therefore, poorly distributed in the radial direction. The heat is not distributed throughout the second feed component 3. This means that the heat radiation effect by the second feed component 3 is low.

Therefore, the heat is stored, especially in the vicinity of the central opening 11 of the lamp main part 1, so that the reflection surface in this area reaches a high temperature. During lamp operation over a long time, as a result, chemical conversion of the vacuum evaporated film of silver, aluminum or the like which is formed on the reflection surface takes place, by which the disadvantages of the formation of a diffusion surface, a color change and a reduction in the reflection factor have occurred. In the case of insufficient cooling in the lamp main part 1 which is formed from ceramic, a large amount of heat is locally stored, by which the defects occurred that a strong thermal distortion occurs and the lamp main part 1 breaks.

Another disadvantage is that the cathode 21 is supported by the conductive electrode support component 5 which is connected to the annular first feed component which is attached in the opening of the lamp main part. But conventionally, as is illustrated in FIG. 7, the cathode 21 is attached by brazing at the intersection of the three conductive electrode support parts 5 with individual ends attached in the first feed component 4 with equal distances of 120° C. and extending into the center of the first feed component 4.

The electrodes reach an extremely high temperature during operation. Also, in the cathode, with a temperature lower than that of the anode, its rear end, i.e. the area connected to the conductive electrode support component 5, has a temperature of roughly 1000° C., which is close to the melting point of the brazing filler metal. Since turning on and off are repeated periodically, as a result of the different coefficients of thermal expansion of the cathode 21 and the conductive electrode support component 5, a stress by thermal shock is exerted on the brazed point. However, since the cathode 21 is attached by the three conductive electrode support components 5, the thermal expansion of the respective conductive electrode support component 5 cannot be not absorbed. The cathode 21 is therefore subjected to complex stresses from three directions until finally cracks occur at the brazed point, the brazing filler metal melts, the position of the cathode changes and on the end the cathode 21 is occasionally separated from the conductive electrode support component 5.

Therefore, one end 5*a* of the conductive electrode support component 5 is connected to the first feed component 4, the other end 5*b* of the conductive electrode support component 5 is positioned in the center of the first feed component 4 and the cathode 21 is attached on this other end 5*b* of the conductive electrode support component 5 and used in practice (published Japanese application HEI 9-161727; U.S. Pat. No. 5,789,863) as is illustrated in FIGS. 5 and 6. FIG. 6 is a schematic of the installation arrangement of the first feed component 4 and the conductive electrode support component 5 to which the cathode 21 is attached, according to FIG. 5.

In periodically repeated turning on and off of the lamp, the tip of the conductive electrode support component 5, i.e. the location at which the cathode 21 is attached, is not subjected to complex stress by this arrangement either. Furthermore, mechanical strength can be reliably guaranteed when the cathode 21 is attached in the conductive electrode support component 5 by welding.

But, it was found that the cathode 21, which is attached to the tip as the free end of the conductive electrode support component 5, when the lamp is subjected to vibration, also vibrates easily and the arc fluctuates because the conductive electrode support component 5 is a cantilever. It was furthermore regarded as disadvantageous that the periodic damping is weak and the vibration lasts a relatively long time once it has started.

Since the conductive electrode support component 5, which reaches a high temperature during operation is attached with only one end to the first feed component 4, therefore, the thermal balance of the annular first feed component is adversely affected. The thermal balance of the lamp main component is therefore also adversely affected. The homogeneity of the gas in the discharge space is therefore adversely affected, and there are cases in which the light emitted from the lamp flickers.

SUMMARY OF THE INVENTION

Therefore, a first object of the present invention is to provide a short arc lamp with a reflection surface integrated in one piece in which, even when the lamp is being operated over a long time, neither a reduction of the reflection factor nor breakage of the lamp main part occurs.

A second object of the present invention is to devise a short arc lamp with a reflection surface integrated in one piece, in which the site at which the cathode and a conductive electrode support component are attached to one another is not subjected to a complex stress during periodically repeated turning on and off, in which, furthermore, the cathode does not vibrate even if the lamp is subjected to vibration and in which no flickering of the light emitted from the lamp occurs.

According to the invention these objects are achieved in a short arc lamp which comprises:

a lamp main part which having an isolator component and in which a concave discharge space is formed with a reflection surface;

a cathode and an anode located opposite one another in the discharge space in the focal position of the reflection surface spaced from one another;

an annular, first feed component which is attached in the opening of the reflection surface of the lamp main part and to which a conductive electrode support component which supports the cathode is connected;

a block-like, second feed component which is located in the base part on the side of the lamp main part opposite the opening and which supports the anode; and a plate-shaped, heat transferring component located between the base surface of the lamp main part and the second feed component, and having a thermal conductivity which is higher than that of the second feed component.

These objects are, furthermore, achieved in accordance with the invention in a short arc lamp which comprises:

a lamp main part which having an isolating component and in which a concave discharge space with a reflection surface is formed;

a cathode and an anode are arranged spaced opposite each other in the discharge space in the focal position of the reflection surface;

an annular first feed component which is attached in the open end of the reflection surface of the lamp main part and to which a conductive electrode support component which supports the cathode is connected;

a block-like second feed component which is located in the base part on the side of the lamp main part which is opposite the opening, and which supports the anode; and the conductive electrode support component being straight, one end thereof being attached in the first feed component, and the other end thereof being loosely installed in a gap formed in the first feed component and secured such that it can move in the radial direction during thermal expansion, and the cathode being attached in the middle of this conductive electrode support component.

In the following the invention is explained using several embodiments shown in the drawings.

DETAILED DESCRIPTION OF THE INVENTION

In the following, a specific example of the invention for achieving the first object is described.

Figure 1:
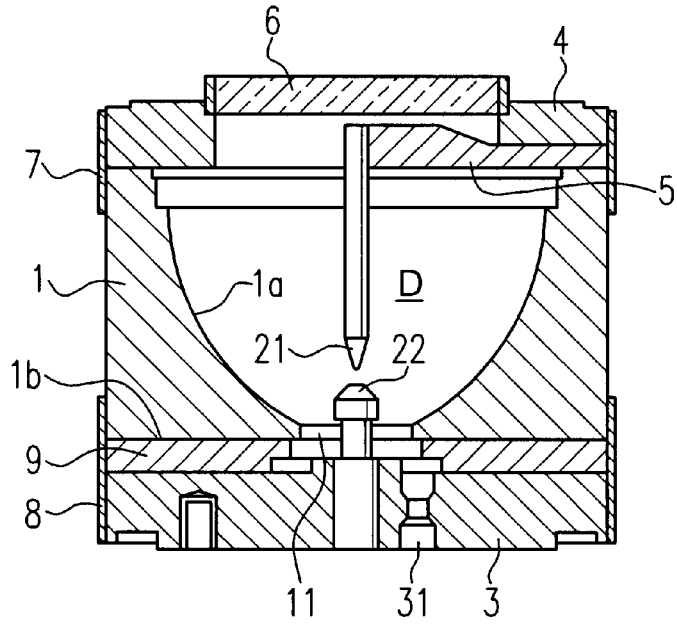
FIG. 1 is a schematic cross section of an embodiment of the invention.

FIG. 1 is a schematic of an example of a short arc lamp according to the present invention. In the representation, a lamp main part 1 of aluminum oxide is an isolator component, has an outside diameter of roughly 60 mm and is cylindrical. Within this lamp main part 1 is a curved reflection surface 1*a*. This reflection surface 1*a* has an oval or parabolic cross-sectional shape to obtain light emergence with high directional accuracy. In this embodiment, it is oval. A metal, such as silver, aluminum or the like, is vacuum evaporated onto the reflection surface 1*a,* and the reflection surface 1*a,* thus, has a mirror-finished surface in order to increase the reflection efficiency. Instead of the vacuum evaporated metal film, a dielectric multilayer film can be used.

The reflection surface la bounds within it a concave discharge space D in which an opposed cathode 21 and anode 22 electrodes are located at a distance of 1 to 2 mm from one another. The arc gap between the electrodes is located in the focal position of the reflection surface 1*a*. Therefore, the light emerges as parallel light. The cathode 21 and the anode 22 are made of tungsten. The tip of the anode 21 has an taper angle of 30° to 50° to obtain good electron emission.

In the opening of the reflection surface 1*a* of the lamp main part 1, there is installed a ring-like, first feed component 4 of Kovar® by a cylindrical attachment component 7 which likewise is made of Kovar® and which has a thickness of roughly 1 mm and a length of roughly 10 mm. In the central opening of the first feed component 4, a window component 6 is installed and attached. The window component 6 is made of sapphire which passes visible radiation and which has a coefficient of thermal expansion near the coefficient of thermal expansion of the Kovar® of which the first feed component 4 is made. The opening of the reflection surface 1*a* is hermetically sealed by the first feed component 4 and the window component 6.

The conductive electrode support component 5 has a width of 5.0 to 7.0 mm and a thickness from 0.4 to 0.8 mm and is made of a molybdenum plate. Its base part is installed and attached in a groove formed in the first feed component 4. The base part of the cathode 21 is welded at the tip of the conductive electrode support component 5 which extends radially inward relative to the first feed component 4. The conductive electrode support component 5 is arranged such that it lies with a narrow side in the plane of the lamp axis to prevent the light reflected from the reflection surface la from being shielded.

At the base part of the lamp main part 1, a block-like second feed component 3 is installed by an attachment component 8. The anode 22 projects from the central opening 11 on the base side of the lamp main part 1 into the discharge space D. The anode 22, which reaches a high temperature during operation, is inserted into the central opening of the second feed component 3 and is brazed into the second feed component 3 by a brazing compound of copper with a high melting point. The second feed component 3 is formed from iron-based metal with a heat resistance temperature higher than the melting point of the copper brazing. A plate-like heat transferring component 9 is tightly sandwiched between the base surface 1*b* of the lamp main part 1 and the second feed component 3. The heat transfer component 9 is made of a metal with high thermal conductivity, for example, of a copper-based metal.

In the second feed component 3, an outlet opening 31 is formed. The inside of the discharge space D is evacuated through this outlet opening 31. Furthermore, discharge space D is filled with an inert gas, for example, xenon with a pressure of a few dozen atm. Afterwards the outlet opening 31 is sealed.

This short arc lamp has, for example, a rated current of 20 A and a power consumption of 300 W. When this short arc lamp is operated, the anode 22 reaches an extremely high temperature. Since the lamp main part 1 is formed from aluminum oxide with low thermal conductivity, the vicinity of the central opening 11 of the lamp main part 1 which is located near the anode 22 reaches a much higher temperature than the other regions.

However, since there is a heat transferring component 9 with high thermal conductivity tightly adjacent the base surface 1*b* of the lamp main part 1, the heat in the vicinity of the central opening 11 of the lamp main part 1 is conducted towards the middle area of the heat transferring component 9, then is quickly distributed in the radial direction of the heat transferring component 9, and at the same time, is conducted by the heat transferring part 9 to the second feed component 3. The temperature gradient in the radial direction of the second feed component 3 is therefore reduced. This means that the heat can be conducted to the entire second feed component 3. The heat conducted to the second feed component 3 is emitted with extremely high efficiency from the face of the second feed component 3. This prevents excess heat from being stored in the vicinity of the central opening 11 of the lamp main part 1.

Therefore, this prevents the metallic film formed on the reflection surface 1*a* by vacuum evaporation from undergoing chemical conversion, and thus, formation of a diffusion surface or to occurrence of a color change. Thus, a reduction of the reflection factor can be prevented. Furthermore, in the lamp main part 1, this prevents thermal distortion by heat stored locally in a large amount. This can prevent the lamp main part 1 from breaking.

Figure 2:
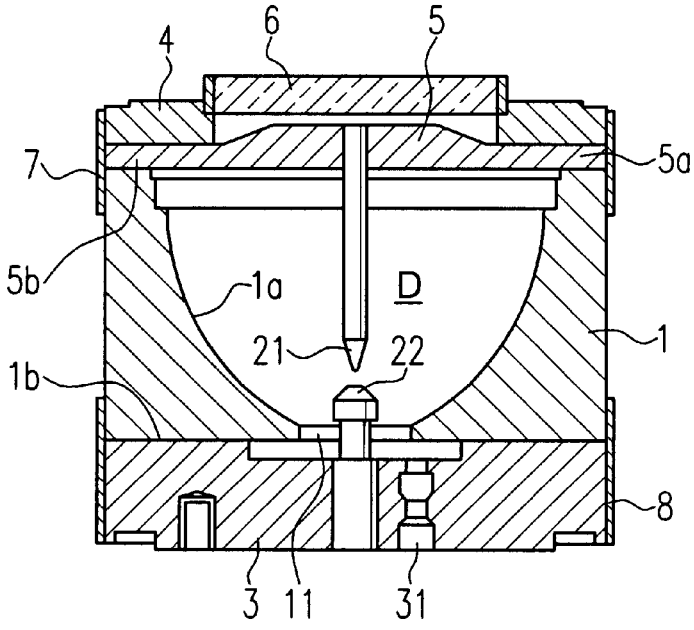
FIG. 2 is a schematic cross section of another embodiment of the invention.

In the following, using FIG. 2, a specific example of the invention for achieving the second object is described. In the representation, the same parts as in FIG. 1 are provided with the same reference numbers.

On the base surface 1*b* of the lamp main part 1, a block-like second feed component 3 is installed with an attachment component 8. The anode 22, which reaches an especially high temperature during operation, is inserted into the central opening of the second feed component 3, is brazed into the second feed component 3 with a copper brazing filler metal having a high melting point, and projects into the discharge space D from the central opening 11 at the base side of the lamp main part 1. The second feed component 3 is formed from ironbased metal with a thermal stability temperature higher than the melting point of the copper brazing filler metal.

Figure 3:
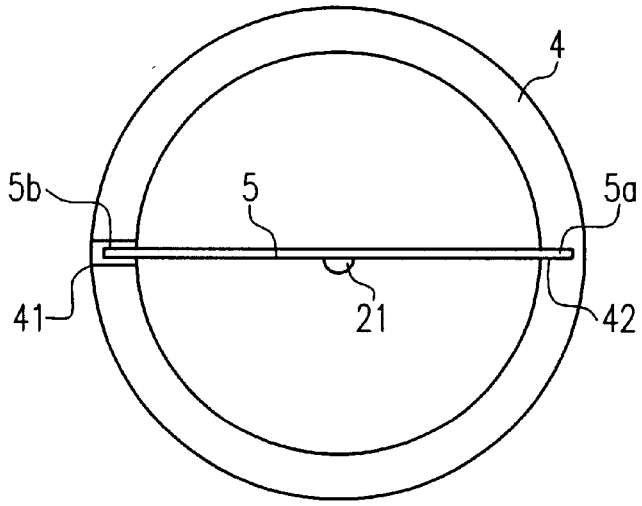
FIG. 3 is a plan view of the installation arrangement of a conductive electrode support component of the FIG. 2 embodiment.

The conductive electrode support component 5 is a straight molybdenum plate having a maximum width of 3.0 to 5.0 mm on the narrow side, a thickness from 0.4 to 0.8 mm and a length essentially equal to the outside diameter of the first feed component 4. An end 5*a* of the conductive electrode support component 5, as illustrated in FIG. 3, is installed in a groove 42 which is formed in the first feed component 4, and attached there by brazing or welding. A groove-shaped gap 41 is formed in an area of the first feed component 4 which is located on an opposite side from the site of groove 42.

Figure 4:
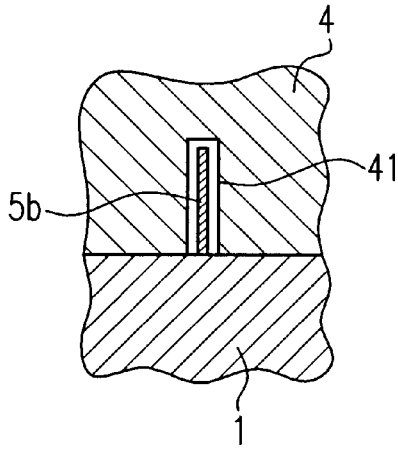
FIG. 4 is a cross-sectional of an end of the installation arrangement of the conductive electrode support component.
Figure 5:
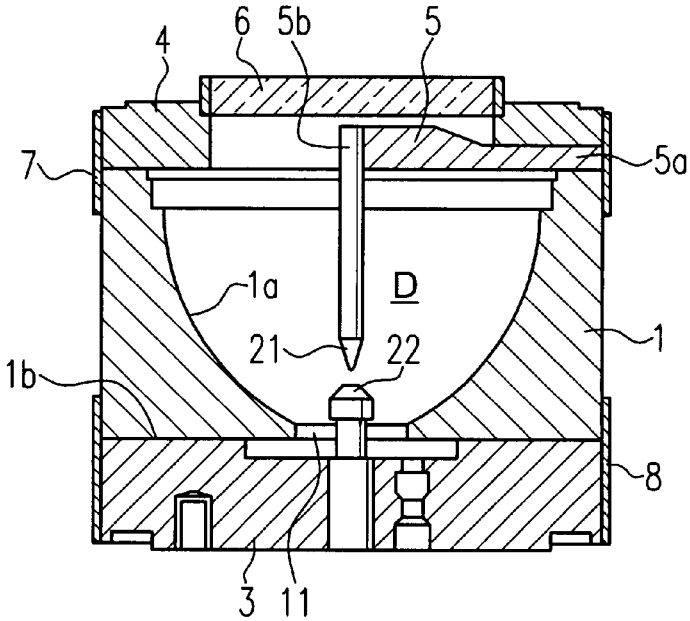
FIG. 5 (PRIOR ART)
FIG. 5 is a view similar to those of FIGS. 1 & 2, but showing a conventional example.
Figure 6:
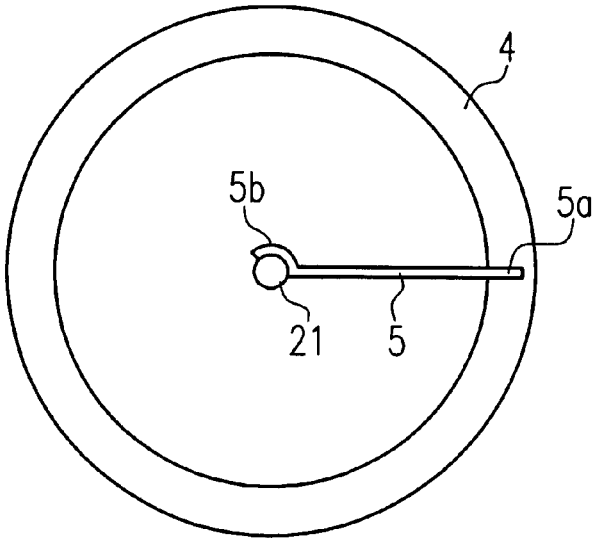
FIG. 6 (PRIOR ART)
FIG. 6 shows a schematic of the installation arrangement of a conventional conductive electrode support component.
Figure 7:
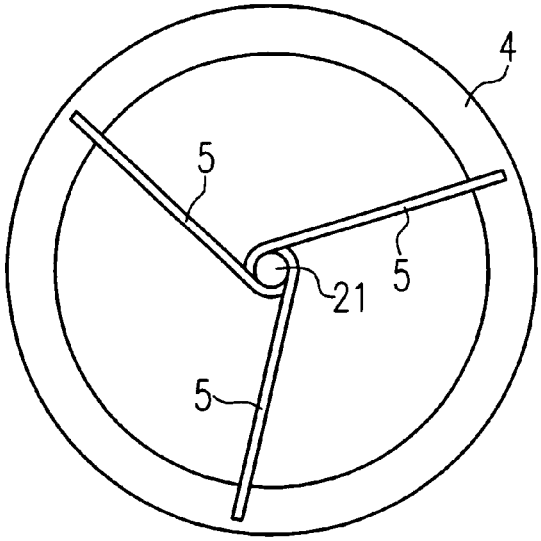
FIG. 7 (PRIOR ART)
FIG. 7 shows a schematic of the installation arrangement of another conventional conductive electrode support component.

As is shown in FIG. 4, the opposite end 5*b* of the conductive electrode support component 5 is installed loosely in the gap 41. This means that, between the end 5*b* of the conductive electrode support component 5 and the inside of the gap 41 there is a small clearance. When the conductive electrode support component 5 expands due to heat, the end 5*b* is kept in a state in which it can move in the gap 41 in the radial direction. In addition, the conductive electrode support component 5 is arranged such that it lies with the narrow side in the plane of the lamp axis to prevent the light reflected from the reflection surface from being significantly shielded by it.

The rear end of the cathode 21 is attached in the middle of the conductive electrode support component 5. This attachment can be done by brazing with a copper brazing filler metal having a high melting point. However, a different attachment process can be used in which, for example, by irradiation with YAG laser light, the two components melt together and are welded to one another. In this way, resistance to stress as a result of thermal shock can be obtained. Furthermore, in this way, mechanical strength can be ensured. The welding means is not limited to YAG laser light, but electron beam welding or plasma arc welding or the like can be used.

This short arc lamp has, for example, a rated current of 20 A and a power consumption of 300 W. When this short arc lamp is operated, the anode 22 and cathode 21 reach a high temperature. Furthermore, the conductive electrode support component 5 reaches a high temperature and expands due to heat. When the lamp is turned off, the conductive electrode support component 5 which has expanded due to heat is returned to the original length. Since the conductive electrode support component 5 formed of a single straight molybdenum plate that has an end 5*b* held in the gap 41 so as to be movable in the radial direction, thermal expansion and contraction are absorbed. Therefore, stress due to thermal shock is not exerted on the location in the middle of the conductive electrode support component 5 where the cathode 21 is attached, even if turning on and off are periodically repeated. Therefore, cathode 21 is not separated from the conductive electrode support component 5.

If a short arc lamp of this type is subjected to vibration, the conductive electrode support component 5 is also subjected to a stress and vibrates. However, since the two ends of the conductive electrode support component 5 are held by the first feed component 4, and thus a simple beam is formed, the middle area of the conductive electrode support component 5 hardly vibrates. Therefore, the cathode 21 hardly vibrates and is not separated from the conductive electrode support component 5. The arc does not fluctuate either.

Since the two ends of the conductive electrode support component 5 which reaches a high temperature during operation conduct heat to the first feed component 4, the thermal balance of the first feed component 4 and the lamp main part 1 is improved. Furthermore, this prevents the light emitted from the lamp from flickering.

While various embodiments in accordance with the present invention have been shown and described, it is understood that the invention is not limited thereto, and is susceptible to numerous changes and modifications as known to those skilled in the art. For example, the features of the two embodiments can be used in conjunction with each other, e.g., the heat transferring component 9 of FIG. 1 being added to the FIG. 2 embodiment at the same location and in the same manner. Therefore, this invention is not intended to be limited to the details shown and described herein, and includes all such changes and modifications as are encompassed by the scope of the appended claims.

Action of the Invention

As was described above, in accordance with the invention, between the base surface of the lamp main part formed of an insulator material with low thermal conductivity and the second feed component with a relatively low thermal conductivity, there is a plate-like heat transferring part with a thermal conductivity higher than that of the second feed component. By this measure, the heat stored locally in the vicinity of the central opening from which the anode of the lamp main part projects can be transmitted by the plate-like, heat transferring component to the entire second feed component with high efficiency. Thus, the vicinity of the central opening from which the anode of the lamp main part projects can be cooled with high efficiency. Therefore, a short arc lamp can be obtained in which neither a reduction of the reflection factor nor breaking of the lamp main part occurs even when the lamp is being operated over a long time.

Furthermore, according to the invention, the conductive electrode support component for the cathode is made straight, one end thereof being attached in the first feed component, the other end thereof being loosely installed in a gap formed in the first feed component and held such that it can move in the radial direction during thermal expansion, and furthermore, the cathode is attached in the middle of this conductive electrode support component. By this measure, the location where the cathode and the conductive electrode support component are attached to one another is not subjected to complicated stress even if turning on and off of the lamp are periodically repeated. Furthermore, there is no vibration of the cathode even if the lamp undergoes vibration. The cathode is, therefore, not separated from the conductive electrode support component. In this way, a short arc lamp with a reflection surface integrated in one piece can be obtained in which the light emitted from the lamp does not flicker.

What we claim is:

1. Short arc lamp comprising:

a lamp main part made of an insulator in which a reflection surface is provided bounding a concave discharge space;

a cathode and an anode located opposite one another in the discharge space with a discharge gap therebetween in a focal position of the reflection surface;

an annular, first feed component attached on an open end of the reflection surface of the lamp main part and to which a conductive electrode support component is connected which supports the cathode;

a block-like, second feed component which supports the anode and which is located at a base surface of the lamp main part at an end opposite the open end; and a plate-shaped, heat transferring component which is located tightly sandwiched between the base surface of the lamp main part and the second feed component and which has a thermal conductivity which is higher than that of the second feed component.

2. Short arc lamp as claimed in claim 1, wherein the second feed component is made of an iron-based metal; and wherein the heat transferring component is made of a copper-based metal.

3. Short arc lamp which comprises:

a lamp main part made of an insulator in which a reflection surface is provided bounding a concave discharge space;

a cathode and an anode located opposite one another in the discharge space with a discharge gap therebetween in a focal position of the reflection surface;

an annular, first feed component attached on an open end of the reflection surface of the lamp main part and to which a conductive electrode support component is connected which supports the cathode;

a block-like, second feed component which supports the anode and which is located at a base surface of the lamp main part at an end opposite the open end; and wherein the conductive electrode support component is straight; wherein one end of the conductive electrode support component is attached in the first feed component; wherein an opposite end of the conductive electrode support component is loosely installed in a gap formed in the first feed component and is held therein in a manner enabling movement thereof in a radial direction of the first feed component during thermal expansion; and wherein the cathode is attached in the center of the conductive electrode support component.

* * * * *